US006659840B2

(12) United States Patent
Chastain et al.

(10) Patent No.: US 6,659,840 B2
(45) Date of Patent: Dec. 9, 2003

(54) SET OF DOLLS FOR SIMULATING A UNIVERSAL BEAUTY PAGEANT

(76) Inventors: Perry R. Chastain, 976 Bob Patten Rd., Clarkesville, GA (US) 30523; Stacey T. Henderson, P.O. Box 117, Turnerville, GA (US) 30580

( * ) Notice: Subject to any disclaimer, the term of this patent is extended or adjusted under 35 U.S.C. 154(b) by 204 days.

(21) Appl. No.: 09/862,931

(22) Filed: May 22, 2001

(65) Prior Publication Data

US 2002/0045400 A1 Apr. 18, 2002

Related U.S. Application Data

(63) Continuation-in-part of application No. 09/527,866, filed on Mar. 17, 2000, now abandoned.
(60) Provisional application No. 60/127,048, filed on Mar. 31, 1999.

(51) Int. Cl.[7] ..... A63H 3/00
(52) U.S. Cl. ..... 446/268
(58) Field of Search ..... 446/268, 330, 446/331, 387, 147, 388, 97–98, 370, 371, 82; 40/358, 725; 434/284, 287, 288, 289, 290–292

(56) References Cited

U.S. PATENT DOCUMENTS

| | | | | |
|---|---|---|---|---|
| 4,398,820 A | | 8/1983 | Thayer | |
| 4,435,915 A | | 3/1984 | Zaruba et al. | |
| 4,480,838 A | | 11/1984 | Aharonian | |
| 4,964,831 A | * | 10/1990 | Wolff | 446/75 |
| 5,062,645 A | * | 11/1991 | Goodman et al. | 273/249 |
| 5,184,958 A | | 2/1993 | Ward et al. | |
| 5,549,499 A | * | 8/1996 | Foskey et al. | 446/268 |
| 5,752,700 A | * | 5/1998 | Delzotti | 273/243 |
| 5,799,791 A | | 9/1998 | Harley | |
| 5,807,112 A | * | 9/1998 | Zeck | 434/127 |
| 5,816,821 A | | 10/1998 | Ouellette et al. | |
| 6,030,274 A | | 2/2000 | Kaplan | |
| 6,164,972 A | * | 12/2000 | Winslow | 434/219 |
| 6,176,705 B1 | * | 1/2001 | Garvey et al. | 434/284 |

OTHER PUBLICATIONS www.kyohaku.go.jp, see attached copy.*
http://cgi.tias.com, see attached copy.*
http://pages.tias.com, see attached copy.*

* cited by examiner

*Primary Examiner*—Jacob K. Ackun
*Assistant Examiner*—Jamila Williams
(74) *Attorney, Agent, or Firm*—Hinkle & O'Bradovich, LLC

(57) ABSTRACT

A set of dolls for simulating a universal beauty pageant, including a plurality of female dolls each being distinguishable from one another. Each of the dolls is wearing a dress with an identifying ribbon thereon. A plurality of educational cards correspond with each of the female dolls. Each of the cards have information thereon relating to a corresponding female doll.

17 Claims, 3 Drawing Sheets

SET OF DOLLS FOR SIMULATING A UNIVERSAL BEAUTY PAGEANT

CROSS-REFERENCE AND RELATED SUBJECT MATTER

This application is a continuation-in-part of co-pending U.S. Utility patent application No. 09/527,866, filed on Mar. 17, 2000 now abandoned, and further relates to subject matter contained in U.S. Provisional Patent Application No. 60/127,048, filed on Mar. 31, 1999, in which both applications were filed in the U.S. Patent and Trademark Office.

BACKGROUND

I. Field of the Invention

The present invention relates generally to dolls and more particularly pertains to simulating a universal beauty pageant where each doll represents each planet in the solar system.

II. Description of the Related Art

The use of dolls is known in the prior art. More specifically, dolls heretofore devised and utilized for the purpose of providing amusement for children are known to consist basically of familiar, expected and obvious structural configurations, notwithstanding the myriad of designs encompassed by the crowded prior art which have been developed for the fulfillment of countless objectives and requirements.

While many dolls and related toys provide entertainment, many dolls fail to provide informational and educational aspects in addition to the entertainment aspects.

SUMMARY OF THE INVENTION

In accordance with the foregoing disadvantages inherent in the known types of dolls now present in the prior art, the present invention provides an improved set of dolls for simulating a universal beauty pageant. As such, the general purpose of the present invention, which will be described subsequently in great detail, is to provide a new and improved set of dolls for simulating a universal beauty pageant and method which has all the advantages of the prior art and none of the disadvantages.

In general, in one aspect, the invention features a set of dolls, including a plurality of dolls each being distinguishable from one another, each of the dolls wearing a dress with an identifying ribbon thereon, wherein the dolls simulate a universal beauty pageant, each doll representing a heavenly body and a plurality of educational cards corresponding with each of the dolls, each of the cards having information thereon relating to a corresponding doll.

In an implementation, the set of dolls further includes a plurality of stands corresponding with each of the dolls, each of the stands supporting a corresponding doll thereon, wherein each of the stands have a circular base portion with a shaft extending upwardly therefrom, an upper end of the shaft having a ring secured thereto, the ring having an opening therein for receiving the doll therein.

In another implementation, the set of dolls further includes a plurality of transportation vessels corresponding with the dolls, each of the vessels being distinguishable from one another.

In another implementation, the set of dolls further includes a pageant stage adapted to receive each of the dolls.

In another implementation, each of the dolls is female and are distinguishable from each other by their skin color, hair color and style, eye color and shape and the dress that each dolls wears.

In another implementation, the heavenly bodies are planets of a solar system including Uranus, Pluto, Neptune, Mars, Earth, Saturn, Venus, Mercury and Jupiter and each of the ribbons includes one of the names of the planets of the solar system.

In yet another implementation, the educational cards include factual information about each of the heavenly bodies and fictional information about each of the dolls.

In still another implementation, the transportation vessels are adapted to fit each of the dolls.

In another aspect, the invention features a doll play set, including a plurality of female dolls each being distinguishable from one another, each of the dolls wearing a dress with an identifying ribbon thereon, a plurality of educational cards corresponding with each of the female dolls, each of the cards having information thereon relating to a corresponding female doll, a plurality of stands corresponding with each of the female dolls, each of the stands supporting a corresponding female doll thereon, each of the stands having a circular base portion with a shaft extending upwardly therefrom, an upper end of the shaft having a ring secured thereto, the ring having an opening therein for receiving the female doll therein, a plurality of transportation vessels corresponding with the female dolls, each of the vessels being distinguishable from one another; and a pageant stage adapted to display each of the dolls with their representative planet.

In an implementation, each of the ribbons includes the name of a individual planet selected from the group including: Uranus, Pluto, Neptune, Mars, Earth, Saturn, Venus, Mercury and Jupiter.

In another implementation, the educational cards include information about the dolls and the planet of the solar system.

There has thus been outlined, rather broadly, the more important features of the invention in order that the detailed description thereof, that follows, may be better understood in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The present invention provides a new and improved set of dolls for simulating a universal beauty pageant which has all the advantages of the prior art dolls and none of the disadvantages.

The present invention further provides a new and improved set of dolls for simulating a universal beauty pageant which may be easily and efficiently manufactured and marketed.

The present invention provides a new and improved set of dolls for simulating a universal beauty pageant which is of durable and reliable construction.

The present invention provides a new and improved set of dolls for simulating a universal beauty pageant that is susceptible of a low cost of manufacture with regard to both materials and labor, and which accordingly is then susceptible of low prices of sale to the consuming public, thereby making such a set of dolls for simulating a universal beauty pageant economically available to the buying public.

The present invention provides a new and improved set of dolls for simulating a universal beauty pageant for representing each planet in the solar system in a play beauty pageant.

The present invention provides a new and improved set of dolls for simulating a universal beauty pageant, including a plurality of female dolls each being distinguishable from one another. Each of the dolls is wearing a dress with an identifying ribbon thereon. A plurality of educational cards correspond with each of the female dolls. Each of the cards have information thereon relating to a corresponding female doll.

One advantage of the invention is that it provides entertainment in the form of dolls in which a person can play individually and which provides a plurality of dolls and accessories to be collected to complete an entire set.

Another advantage is that the invention provides education and information regarding the solar system.

Another advantage is that the dolls represent not only different planets, but also represent an understanding and acceptance of several races of humans.

These together with other objects of the invention, along with various features of novelty which characterize the invention, are pointed out with particularity in the claims annexed to and forming a part of this disclosure. For a better understanding of the invention and its operating advantages, and the specific objects attained by its uses, reference should be had to the accompanying drawings and descriptive matter in which there is illustrated preferred embodiments of the invention.

DETAILED DESCRIPTION OF THE INVENTION

Figure 1:
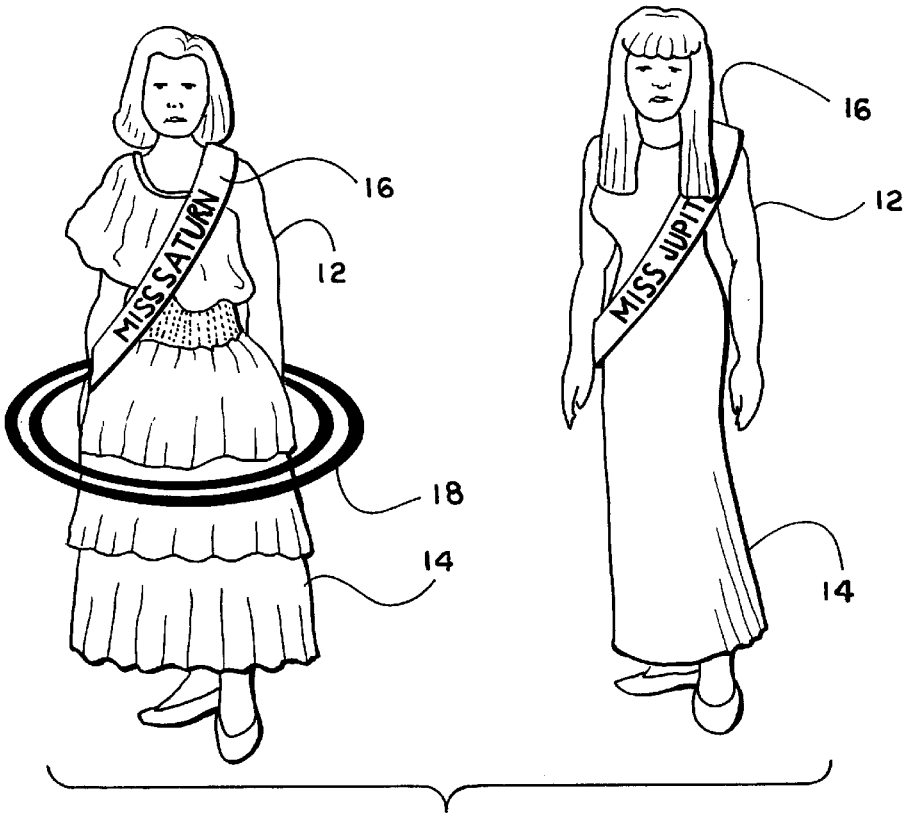
FIG. 1 illustrates a perspective view of the set of dolls for simulating a universal beauty pageant.
Figure 2:
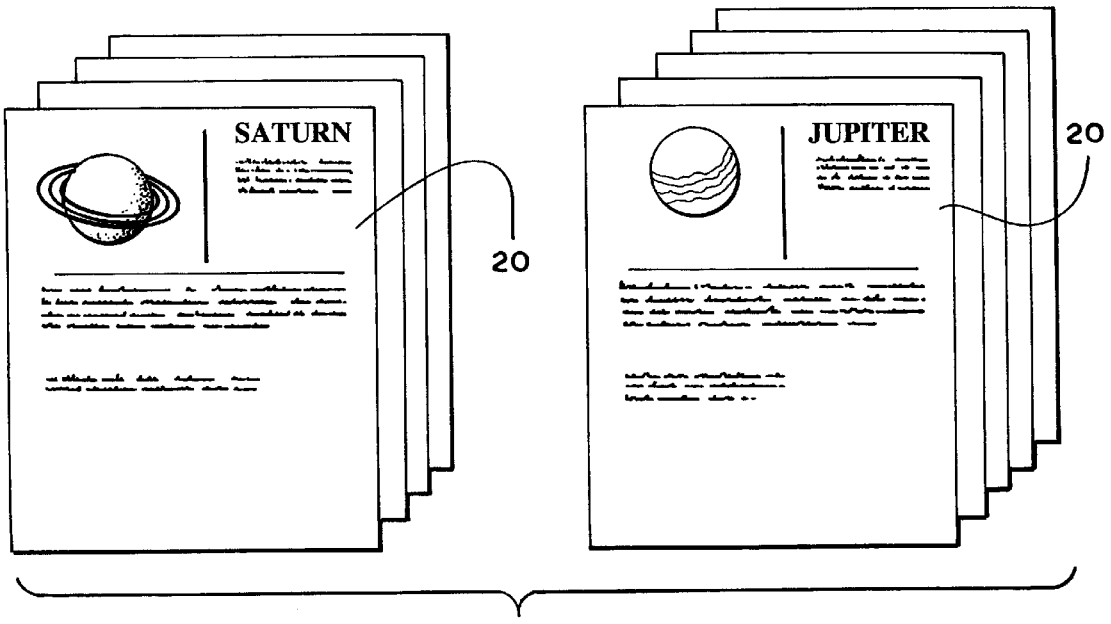
FIG. 2 illustrates a front view of the description sheet for the contestants.
Figure 3:
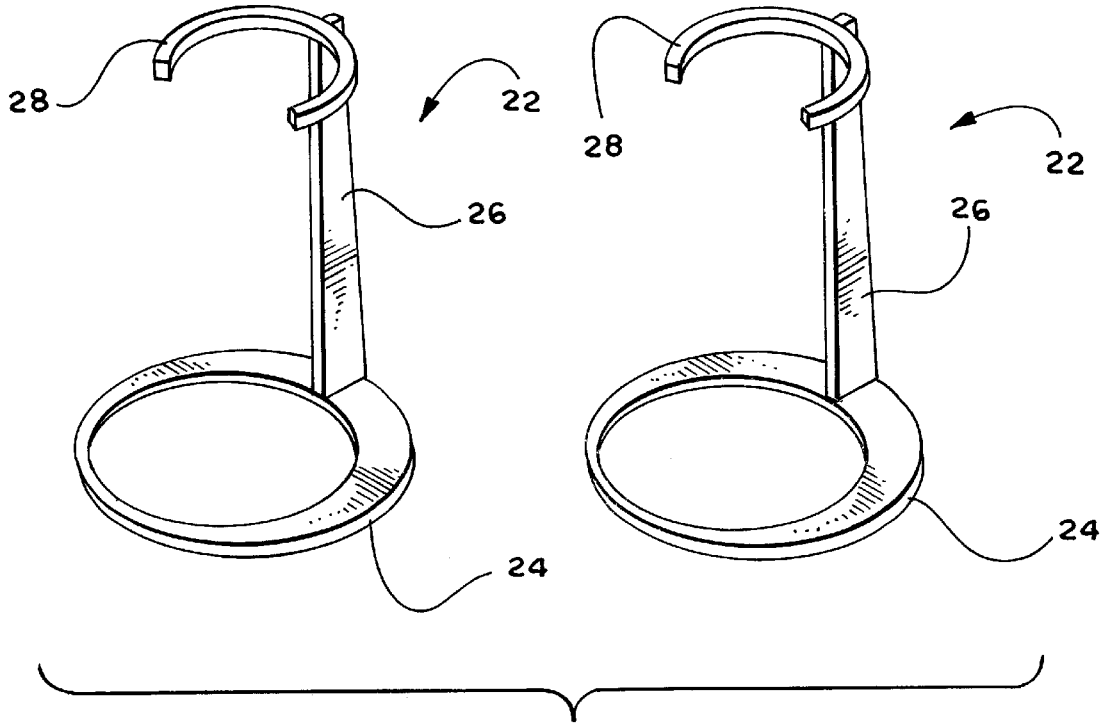
FIG. 3 illustrates a perspective view of an embodiment of a stand.

Referring to the drawings wherein like reference numerals designate corresponding parts throughout the several figures, reference is made first to FIGS. 1–4 thereof and to the preferred embodiment of the new and improved set of dolls for simulating a universal beauty pageant embodying the principles and concepts of the present invention, and generally designated by the reference number 10, will be described.

Specifically, it will be noted in the various figures that the device relates to a set of dolls for simulating a universal beauty pageant for representing each planet in the solar system in a play beauty pageant. In its broadest context, the device includes of a plurality of female dolls, a plurality of educational cards, a plurality of stands and a plurality of transportation vessels. The device further includes a simulated stage for the pageant in which all of the dolls and optionally the ships can be displayed. This stage is representative of a typical stage in which the contestants in the contest stand. Such components are individually configured and correlated with respect to each other so as to attain the desired objective.

The plurality of female dolls 12 each are distinguishable from one another typically by physical characteristics. In an implementation, the dolls can be distinguished from one another by the pigment of their skin. For example, the further the planet that a doll 12 represents is away from the sun, the lighter the skin color and the darker the hair color of that doll 12 will be. Thus, the doll 12 representing Pluto will have the lightest skin and the darkest hair, and the doll 12 representing Mercury will have the darkest skin and the lightest hair. Additionally, the doll 12 representing Saturn will have a ring 18 incorporated into her dress. Note FIG. 1. In another implementation, the dolls can be distinguished by other features such as hair style and color, eye shape and color as well as body type. It is understood that several other distinguishing features can be added. Each of the dolls 12 is wearing a dress 14 with an identifying ribbon 16 thereon. Each of the female dolls represents the planets in the solar system. Therefore, the identifying ribbon 16 can denote which planet the doll 12 represents.

The plurality of educational cards 20 correspond with each of the female dolls 12. Each of the cards 20 have information thereon relating to a corresponding female doll 12. The educational cards 20 describe the planet from where each doll 12 comes and give vital statistics about the planet and the doll. In an implementation, the card can contain factual information about the planet explaining that most planets in reality could not sustain life. In another implementation, the card contains fictional information about the doll's home on the planet and how life exists on that planet. Note FIG. 2. Typically the planets include Mercury, Mars, Venus, Earth, Jupiter, Saturn, Uranus, Neptune and Pluto. In another embodiment, further planets can include moons and other satellites of the planets. For example, additional dolls can be added to represent earth's moon or one or more moons of Jupiter such as Europa and Io. It is understood that scientists discover new planets and moons. In other embodiments, further dolls can be added to the collection to represent other planets, moons, satellites, stars, suns, comets and other heavenly bodies.

The plurality of stands 22 correspond with each of the female dolls 12. Each of the stands 22 supports a corresponding female doll 12 thereon. Each of the stands 22 have a circular base portion 24 with a shaft 26 extending upwardly therefrom. An upper end of the shaft 26 has a ring 28 secured thereto. The ring 28 has an opening therein for receiving the female doll 12 therein. Note FIG. 3. In another embodiment, the stand can include a peg on the circular base portion 24. In addition, teach doll can have a hole in its foot to engage with the peg.

Figure 4:
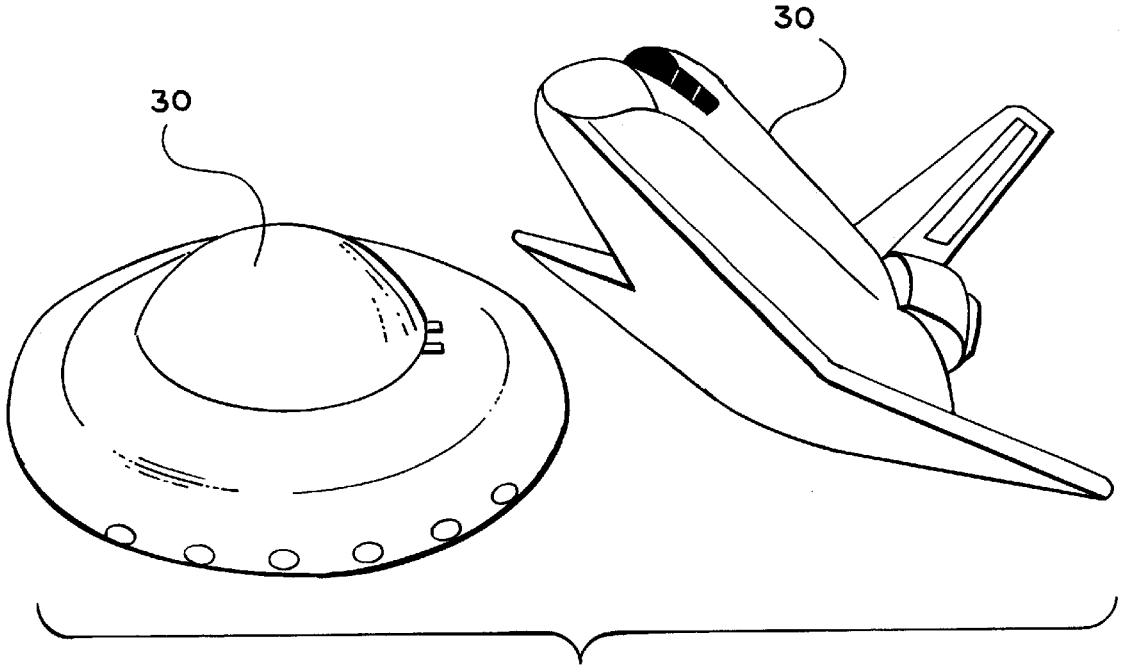
FIG. 4 illustrates a perspective view of an embodiment of a space ship.

The plurality of transportation vessels 30 correspond with the female dolls 12. Each of the vessels 30 are distinguishable from one another. FIG. 4 illustrates a flying saucer that reflects properties of one of the planets. Each transportation vessel is unique to each of the planets. The uniqueness of the ship can vary. For example, the ship for earth can be a Space Shuttle, or rockets similar to those used in the Apollo and Mercury space missions on earth. The transportation vessels can be adapted to fit each of the dolls thereby simulating the doll as a pilot of the vessel.

Figure 5:
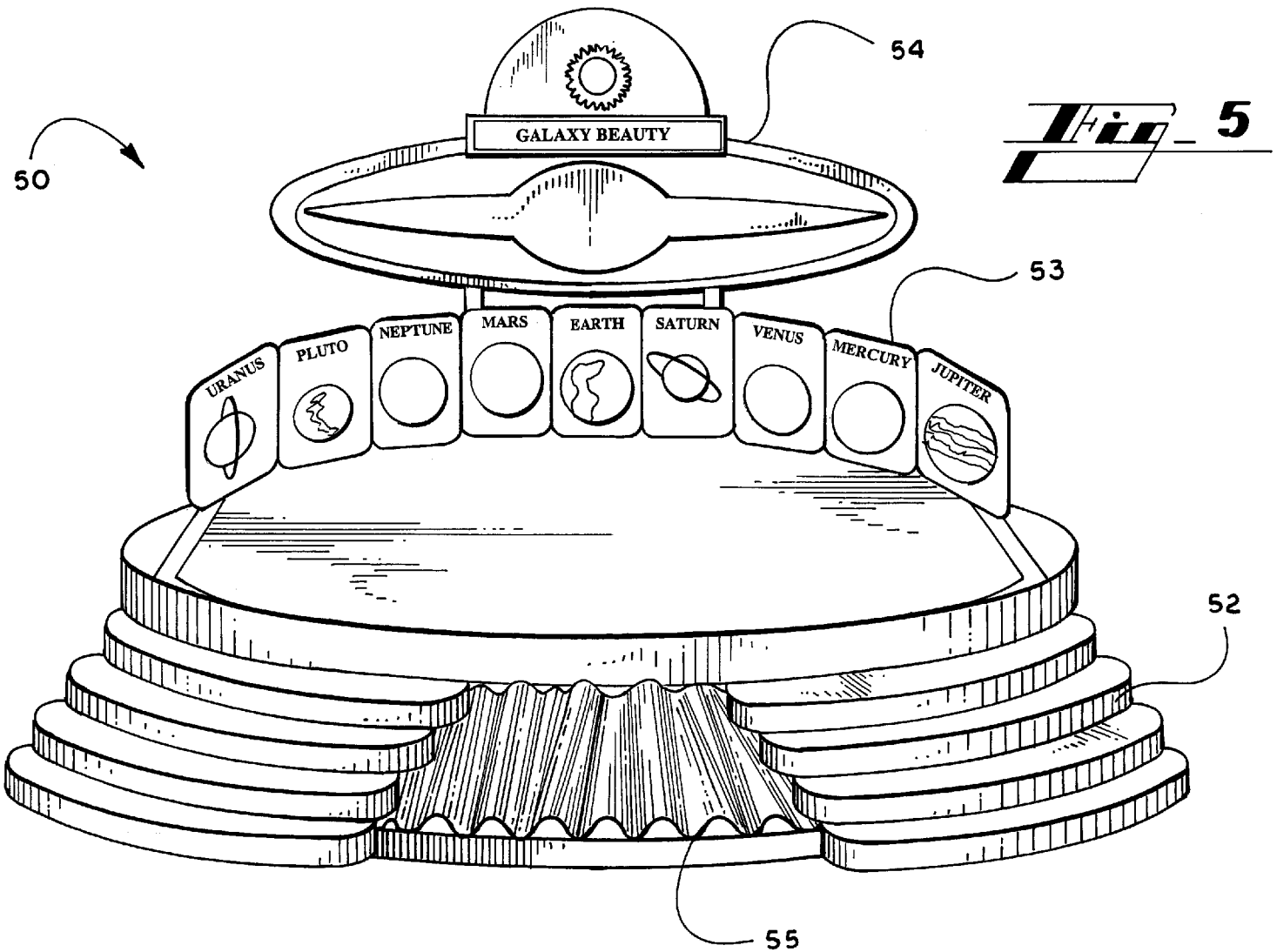
FIG. 5 illustrates an embodiment of a pageant stage.

FIG. 5 illustrates an embodiment of a pageant stage 50. The stage can include a main stage floor 51. In one implementation, the dolls can be displayed on the stage floor 51 on their individual stands. In another the floor 51 can include a plurality of foot pegs in which corresponding holes on each of the dolls' feet can be inserted onto the pegs to secure the dolls to the floor 51. The floor 51 is further adapted to include an accessories that may be included in the doll play set such as furniture microphones, lights, a pageant coordinator doll and the like.

The stage 50 can further include stairs 52, insignia 53, a banner 54 and other decoration 55. The insignia 53 can simply be a sign indicating the name of the planet and a picture of the planet from which the doll comes. In another implementation, the insignia 53 can include a holder for the educational cards. In this implementation, the cover of the educational cards includes the name and picture of the planet that can be placed into the holder. The user of the playset can remove the educational card to read about the planet and the doll. The banner 54 can signify the pageant. For example, the banner 54 can state "The Universal Pageant: Galaxy Beauty". It is understood that the banner 54 is adapted to contain other words or pictures.

The present invention is an educational tool that educates children about the planets in the solar system and further provides factual and fictional entertainment about life on those planets. The dolls 12 can be utilized in a mock beauty pageant or positioned in a way to signify the positioning of the planets in the solar system in relation to the sun.

As to the manner of usage and operation of the present invention, the same should be apparent from the above description. Accordingly, no further discussion relating to the manner of usage and operation is provided.

With respect to the above description then, it is to be realized that the optimum dimensional relationships for the parts of the invention are deemed readily apparent and obvious to one skilled in the art, to include variations in size, materials, shape, form, function and the manner of operation, and assembly and use. Also, all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described. Accordingly, all suitable modifications and equivalents may be resorted to which fall within the scope of the invention.

What is claimed is:

1. A set of dolls, comprising:

a plurality of dolls each being distinguishable from one another, each of the dolls wearing a dress with an identifying ribbon thereon, the ribbons including names of planets of a solar system, wherein the dolls simulate a universal beauty pageant, whereby each doll represents a planet of the solar system as indicated by the presence of the ribbon on the doll; and a plurality of educational cards corresponding with each of the dolls, each of the cards having information thereon relating to a corresponding doll.

2. The set of dolls as claimed in claim 1 further including a plurality of stands corresponding with each of the dolls, each of the stands supporting a corresponding doll thereon.

3. The set of dolls as claimed in claim 2, wherein each of the stands have a circular base portion with a shaft extending upwardly therefrom, an upper end of the shaft having a ring secured thereto, the ring having an opening therein for receiving the doll therein.

4. The set of dolls as claimed in claim 1 and further including a plurality of transportation vessels corresponding with the dolls, each of the vessels being distinguishable from one another.

5. The set of dolls as claimed in claim 1 further comprising a pageant stage adapted to receive each of the dolls.

6. The set of dolls as claimed in claim 1 wherein each of the dolls is female.

7. The set of dolls as claimed in claim 1, wherein the dolls are distinguishable from each other by their skin color.

8. The set of dolls as claimed in claim 1, wherein the dolls are distinguishable from each other by their hair color and style.

9. The set of dolls as claimed in claim 1, wherein the dolls are distinguishable from each other by their eye color and shape.

10. The set of dolls as claimed in claim 1, wherein the dolls are distinguishable from each other by the dress that each doll wears.

11. The set of dolls of claim 1 wherein the planets of the solar system are selected from the group consisting of: Uranus, Pluto, Neptune, Mars, Earth, Saturn, Venus, Mercury and Jupiter.

12. The set of dolls as claimed in claim 1, wherein the educational cards include factual information about each of the planets of the solar system.

13. The set of dolls as claimed in claim 1, wherein the educational cards include fictional information about each of the dolls.

14. The set of dolls as claimed in claim 4, wherein the transportation vessels are adapted to fit each of the dolls.

15. A doll playset, comprising:

a plurality of female dolls each being distinguishable from one another, each of the dolls wearing a dress with an identifying ribbon thereon, a plurality of educational cards corresponding with each of the female dolls, each of the cards having information thereon relating to a corresponding female doll, a plurality of stands corresponding with each of the female dolls, each of the stands supporting a corresponding female doll thereon, each of the stands having a circular base portion with a shaft extending upwardly therefrom, an upper end of the shaft having a ring secured thereto, the ring having an opening therein for receiving the female doll therein, a plurality of transportation vessels corresponding with the female dolls, each of the vessels being distinguishable from one another, and a pageant stage adapted to display each of the dolls with their representative planet.

16. The doll playset as claimed in claim 15, wherein each of the ribbons includes the name of an individual planet selected from the group consisting of: Uranus, Pluto, Neptune, Mars, Earth, Saturn, Venus, Mercury and Jupiter.

17. The doll playset as claimed in claim 16, wherein the educational cards include information about the dolls and the planet of the solar system.

* * * * *